US007993130B2

(12) United States Patent
Lewin et al.

(10) Patent No.: US 7,993,130 B2
(45) Date of Patent: Aug. 9, 2011

(54) METHOD OF COMBUSTION WITH THE AID OF BURNERS IN INDUSTRIAL FURNACES, AND A BURNER TO THIS END

(75) Inventors: Thomas Lewin, Hallstahammar (SE); Pauli Mäenpää, Arboga (SE); Jörgen Sjöberg, Västerås (SE); Ole Stadum, Gran (NO)

(73) Assignee: Sandvik Intellectual Property AB, Sandviken (SE)

( * ) Notice: Subject to any disclaimer, the term of this patent is extended or adjusted under 35 U.S.C. 154(b) by 297 days.

(21) Appl. No.: 11/665,761

(22) PCT Filed: Oct. 10, 2005

(86) PCT No.: PCT/SE2005/001494

§ 371 (c)(1),
(2), (4) Date: Jun. 7, 2007

(87) PCT Pub. No.: WO2006/043869

PCT Pub. Date: Apr. 27, 2006

(65) Prior Publication Data

US 2008/0085485 A1 Apr. 10, 2008

(30) Foreign Application Priority Data

Oct. 22, 2004 (SE) ..... 0402560

(51) Int. Cl.
*F23C 3/00* (2006.01)
*F23C 9/08* (2006.01)

(52) U.S. Cl. ..... 431/116; 431/5; 431/9; 431/115; 431/220; 431/354; 75/10.36; 75/549; 126/91 A; 422/227; 432/72

(58) Field of Classification Search ..... 431/354, 431/116, 5, 9, 115, 220; 126/91 A; 75/10.36, 75/549, 550; 422/227; 432/72, 176
See application file for complete search history.

(56) References Cited

U.S. PATENT DOCUMENTS 1,339,579 A * 5/1920 Runyan ..... 239/406
(Continued)

FOREIGN PATENT DOCUMENTS

DE 3636787 A1 * 5/1988
(Continued)

OTHER PUBLICATIONS

File "NOx Formation.pdf"; "Combustion Engineering Issues for Solid Fuel Systems (2008)"; Editors Bruce G. Miller et al.; © www.knovel.com; p. 868.*

*Primary Examiner* — Steven B McAllister
*Assistant Examiner* — Daniel E Namay
(74) *Attorney, Agent, or Firm* — Young & Thompson

(57) ABSTRACT

Method of combustion with a gas burner having a burner head at one end of an inner gas pipe surrounded by an outer protective pipe, wherein gases from the burner head flow inside the inner pipe and inside the outer pipe and thereafter flow into an exhaust channel. The inner pipe terminates short of the burner head; a sleeve downstream of the burner head, is inserted into and/or placed concentrically with the inner pipe so that the sleeve orifice is located within the inner pipe; a gap is provided between the opening of the inner pipe and the sleeve. The gap is sized such that the mixture of fuel and combustion air from the burner head and recycled exhaust gases passing through the gap will be mixed in quantities at which the temperature of combustion will be lower than the temperature in which $NO_x$ is formed.

20 Claims, 2 Drawing Sheets

U.S. PATENT DOCUMENTS

Figure 1:
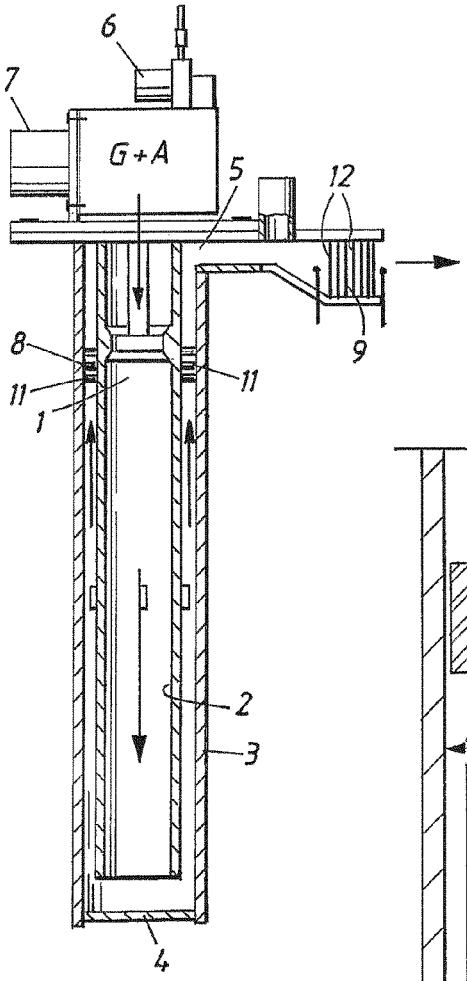

| | | | | | |
|---|---|---|---|---|---|
| 1,374,045 | A | * | 4/1921 | Vezie | 431/116 |
| 1,381,144 | A | * | 6/1921 | Vallely | 431/354 |
| 2,517,399 | A | * | 8/1950 | McCollum | 126/116 R |
| 3,174,526 | A | * | 3/1965 | Von Linde | 431/116 |
| 3,266,485 | A | * | 8/1966 | Zender | 126/360.1 |
| 3,620,513 | A | * | 11/1971 | Hans-Joachim et al. | 432/10 |
| 3,688,760 | A | * | 9/1972 | Rudin | 126/91 A |
| 3,724,447 | A | * | 4/1973 | Parkhill et al. | 266/200 |
| RE28,679 | E | * | 1/1976 | Robinson | 431/9 |
| 3,946,719 | A | * | 3/1976 | Bark et al. | 126/91 A |
| 4,000,978 | A | * | 1/1977 | Henrie | 422/109 |
| 4,004,875 | A | * | 1/1977 | Zink et al. | 431/9 |
| 4,005,977 | A | * | 2/1977 | Kawamura | 431/116 |
| 4,023,921 | A | * | 5/1977 | Anson | 431/9 |
| 4,156,591 | A | * | 5/1979 | Anderson | 431/354 |
| 4,373,903 | A | * | 2/1983 | Wunning | 431/215 |
| 4,401,099 | A | * | 8/1983 | Collier | 126/91 A |
| 4,416,613 | A | * | 11/1983 | Barisoff | 431/243 |
| 4,493,309 | A | * | 1/1985 | Wedge et al. | 431/116 |
| 4,508,501 | A | * | 4/1985 | Kuhn | 431/2 |
| 4,894,006 | A | * | 1/1990 | Cassagne et al. | 431/116 |
| 5,305,732 | A | | 4/1994 | Wunning et al. | |
| 5,350,293 | A | * | 9/1994 | Khinkis et al. | 431/116 |
| 5,388,985 | A | * | 2/1995 | Musil et al. | 431/116 |
| 5,554,347 | A | * | 9/1996 | Busson et al. | 422/204 |
| 6,051,204 | A | * | 4/2000 | Bowe et al. | 423/659 |
| 6,322,002 | B1 | * | 11/2001 | Forsythe et al. | 239/135 |
| 6,383,461 | B1 | * | 5/2002 | Lang | 423/235 |
| 6,425,754 | B1 | * | 7/2002 | Lindskog | 431/5 |
| 6,872,070 | B2 | * | 3/2005 | Moore et al. | 431/9 |
| 6,890,172 | B2 | * | 5/2005 | Stephens et al. | 431/9 |
| 6,893,252 | B2 | * | 5/2005 | Stephens et al. | 431/9 |
| 7,196,263 | B2 | * | 3/2007 | Fraas et al. | 136/253 |
| 2001/0034001 | A1 | * | 10/2001 | Poe et al. | 431/116 |
| 2001/0049076 | A1 | * | 12/2001 | Schindler et al. | 431/5 |
| 2003/0175635 | A1 | * | 9/2003 | Stephens et al. | 431/9 |
| 2004/0096794 | A1 | * | 5/2004 | Lovgren et al. | 431/353 |

FOREIGN PATENT DOCUMENTS

| | | | | |
|---|---|---|---|---|
| DE | 3715373 | | | 11/1988 |
| DE | 3715373 | A1 | * | 11/1988 |
| DE | 4225557 | | | 2/1994 |
| DE | 19536706 | A1 | * | 4/1997 |
| EP | 0384277 | A2 | * | 2/1990 |
| EP | 0384277 | | | 8/1990 |
| EP | 0789186 | | | 8/1997 |
| GB | 2057652 | A | * | 4/1981 |
| JP | 54017533 | A | * | 2/1979 |
| JP | 58120013 | A | * | 7/1983 |
| JP | 59052133 | A | * | 3/1984 |
| JP | 03011202 | A | * | 1/1991 |
| JP | 2006029638 | A | * | 2/2006 |
| JP | 2010139216 | A | * | 6/2010 |
| WO | 02/075209 | | | 9/2002 |
| WO | WO 2075209 | A1 | * | 9/2002 |
| WO | WO 3034507 | A1 | * | 4/2003 |

* cited by examiner

METHOD OF COMBUSTION WITH THE AID OF BURNERS IN INDUSTRIAL FURNACES, AND A BURNER TO THIS END

The present invention relates to a method of combustion with the aid of burners in industrial furnaces, and to a burner for this end.

More specifically, the invention relates to a gas fired burner.

It is common practice to heat industrial furnaces with the aid of gas burners. A typical fuel is natural gas, although other gases can be used, such as propane, butane, and LEP-gas.

One example of an effective gas burner resides in a burner of the type in which the burner head is placed at one end of an inner gas pipe that is surrounded externally by a protective pipe which has a closed bottom. The fumes emitted from the burner chamber pass within the inner pipe down towards the bottom of the outer pipe, where they turn to flow between the outer pipe and the inner pipe in an opposite direction and thereafter into an exhaust channel which leads to the surroundings. The protective pipe emits heat to a furnace space by conviction to an extent of 30 percent and by radiation of an extent of 70 percent.

Such gas burners emit high contents of nitrogen compounds ($NO_x$). The hydrogen carbide contents (HC) and the carbon monoxide contents (CO) are low. The CO-content is roughly equal to zero.

It is desirable that the temperature of the outer pipe reaches to about 1150-1200 degrees C., so as to thereby enhance the power concentration of the burner. For this reason, the pipe is made of a high temperature material such as silicon carbide (SiC) or APM. APM is a powder metallurgical material that contains Fe, Cr and Al. The powder material is extruded into a pipe form.

However, the $NO_x$-content of the exhaust fumes increases greatly at such high temperatures.

Swedish patent specification number 518816 describes a method and a gas burner for heating furnaces, where the gas burner is of a type with which the burner head is placed at one end of an inner furl pipe around which an external protective pipe is placed, wherewith the fuel gases from the burner head pass within the inner pipe and within the outer pipe and thereafter into an exhaust gas channel that leads to the surroundings. Two catalysts (8, 9) are placed mutually sequentially in the flow direction, where the first catalyst (8) is adapted to reduce $NO_x$ to $N_2$ when the exhaust gas has a sufficiently high CO-content, this reduction being sufficient to bring the $NO_x$-content down to a pre-determined value. An oxygen ($O_2$) inlet is provided between the first and the second catalyst. This second catalyst is adapted to oxidize CO and HC to $CO_2$ and $H_2O$ in the presence of oxygen, this oxidation being such as to bring the CO-content to a pre-determined value. There are thus required two catalysts and the measurement of the lambda value for controlling the oxygen supply.

The present invention relates to a method and to a burner with which the formation of nitrogen oxide ($NO_x$) is suppressed, therewith considerably facilitating the production of clean exhaust gases.

The present invention thus relates to a method of combustion with the aid of a furnace heating furnaces gas burner which is of the type with which the burner head is placed at one end of an inner pipe (2) which is surrounded by an outer protective pipe (3), wherewith the fuel gases from the burner head (1) flow within the inner pipe and within the outer pipe and thereafter into an exhaust gas channel (5) which leads to the surroundings, wherein the invention is characterized by causing the inner pipe to terminate short of the burner head; in that a sleeve is placed upstream of the burner head of said burner; wherein the sleeve is caused to be inserted somewhat into and/or to lie concentrical with the inner pipe so that its orifice will be located within the inner pipe; in that a gap is formed between the opening of the inner pipe and the sleeve; in that the size of the gap is caused to be such that the mixture of fuel and combustion-air arriving from the burner head and the exhaust gases re-circulated through the gap is in a quantity such that the temperature of combustion will be below the temperature at which $NO_x$ is formed.

The invention also relates to a burner of the kind that has generally the features set forth in claim 11.

Figure 2:
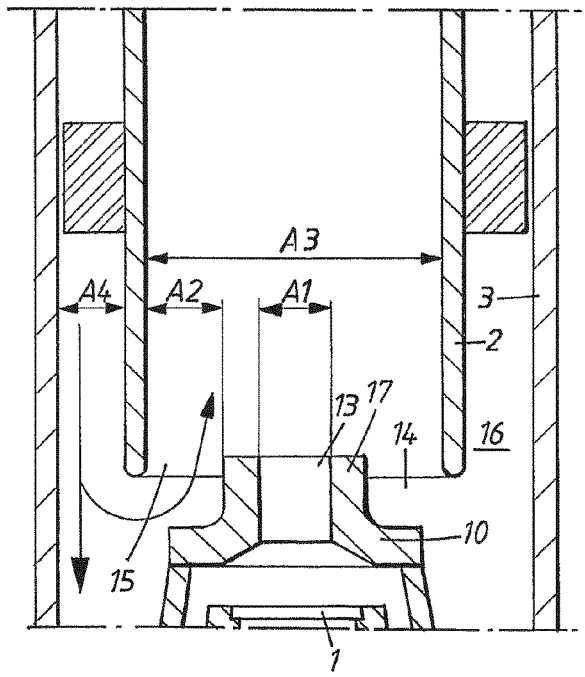
PRIOR ART Fig. 2
Figure 3:
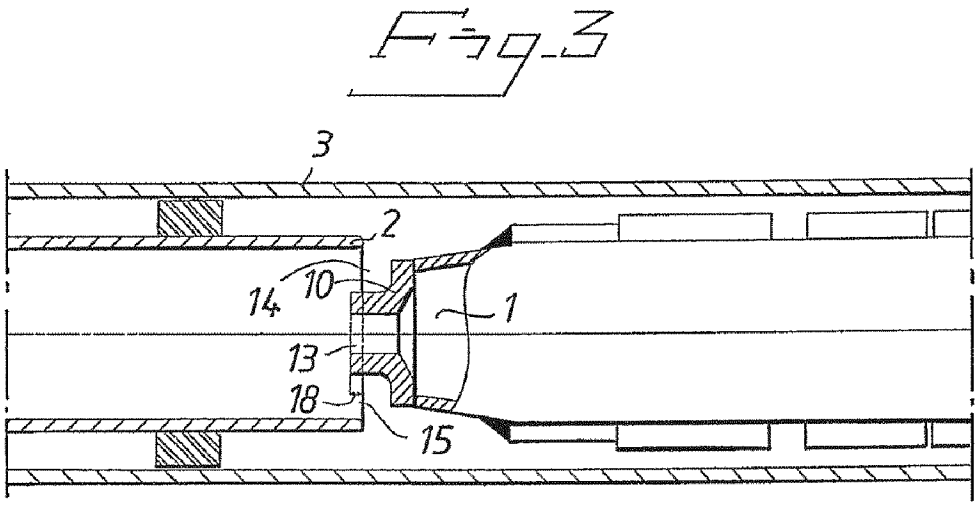
Figure 4:
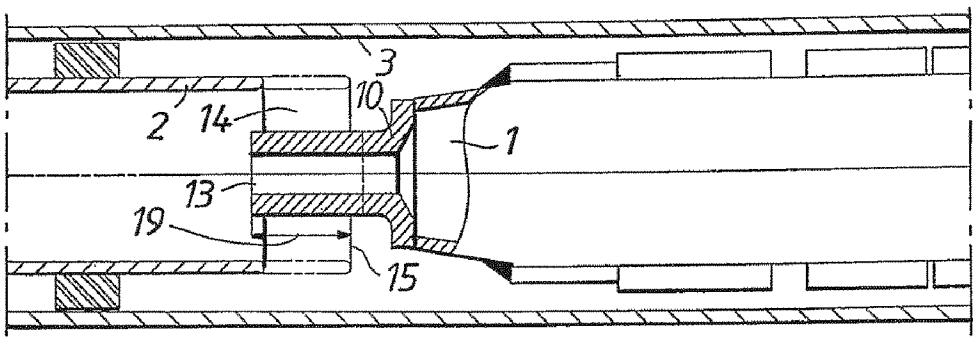

The invention will now be described in more detail, partially with reference to exemplifying embodiments of the invention illustrated in the accompanying drawings, in which FIG. 1 is a diagrammatic cross-sectional view of a known gas burner;

FIG. 2 illustrates in larger scale the area around a sleeve opening and the inlet to an inner pipe; and FIG. 3 and FIG. 4 illustrate respective embodiments of a part of the burner in the vicinity of said sleeve and the inlet of the inner pipe.

FIG. 1 illustrates a known type of furnace heating gas burner. The gas burner is of the kind with which the burner head 1 is placed at one end of an inner pipe 2 which is surrounded by an outer protective pipe 3. The protective pipe 3 is closed at its bottom 4. This means that the exhaust gas from the burner head will flow inside the inner pipe 2 down towards the bottom 4 of the outer pipe 3, where said gas turns and flows in the space between the outer pipe and the inner pipe in the reverse direction and thereafter into an exhaust gas channel 5 which leads to the surroundings.

A recuperator is comprised of that part of the inner gas pipe 2 that surrounds the burner head, or, alternatively, is comprised of a separate pipe that surrounds the burner head, wherewith a separate inner pipe is provided in the extension of said separate pipe. This separate pipe and the separate inner gas pipe are thus axially in line with one another. The separate inner gas pipe commences at the open end of the separate pipe. Fuel gas is introduced through an inlet 6 and air is introduced through an inlet 7.

The reference numeral 11 in FIG. 1 identifies such networks in respect of the first catalyst 8, and the reference numeral 12 identifies disc-like networks in respect of the second catalyst 9. The advantage afforded by such catalysts is that they can withstand higher temperatures than catalysts comprised of ceramic monoliths. Moreover, the flow resistance is lower than that of typical catalysts.

The present invention relates to a method pertaining to this type of burner, i.e. to a gas burner of the type with which the burner head 1 is placed at one end of an inner gas pipe 2 which is surrounded by an outer protective pipe 3 wherein the fuel gases from the burner head flow within the inner gas pipe 2 and thereafter turn at the closed end 4 of the outer protective pipe and continue in the space between the outer pipe 3 and the inner gas pipe 2 and thereafter pass into an exhaust gas channel 5 which leads to the surroundings.

According to the invention, the inner gas pipe 2 terminates short of the burner head 1. A sleeve 10 is placed downstream of the burner head 1 and is caused to be inserted slightly into and/or lie concentrically with the inner gas pipe 2, so that the orifice 13 of said sleeve will be located within the inner pipe 2. A gap 14 is formed between the opening 15 of the inner pipe 2 and the sleeve 10. The size of the gap 14 is caused to be such that the fuel and combustion-air mixture arriving from the burner head and the exhaust gas re-circulated through the gap 14 will be mixed in a quantity such that the temperature of combustion will be lower than the temperature at which $NO_x$ is formed.

$NO_x$ is formed at different temperatures, depending on the type of combustion plant and the type of fuel used. In the present case, it is preferred that the temperature of combustion will not exceed roughly 1600 degrees C.

The burner according to the present invention is primarily intended for natural gas, bottled gas, propane or butane fuels.

According to one preferred embodiment of the invention, the gap 14 is given a size at which the $NO_x$-content or $NO_x$-concentration of the fuel gases will be less 125 ppm.

According to another preferred embodiment of the invention, the gap is given a size such that the $NO_x$-content or $NO_x$-concentration will be less than 25 ppm.

In one preferred method of the invention, it is preferred that the lambda value will be caused to lie close to the value one.

According to a particularly preferred embodiment, the lambda value is caused to be 0.940 at its lowest.

The inventive burner provides conditions by means of which there is achieved a sufficiently large recirculation of fuel gases in the space between the inner and the outer pipes and with which, due to the presence of said gap, there is obtained an ejector effect which causes part of the fuel gases to be sucked into the inner gas pipe together with the fuel mixture from the burner head. As a result, the access to oxygen has a limiting effect of the combustion process. In turn, this results in a longer reaction distance between oxygen and nitrogen gas, which suppresses the formation of $NO_x$.

According to one preferred embodiment of the invention, the ratio between the cross-sectional area A1 of the sleeve outlet opening 13 and the cross sectional area A2 of the gap 14 is caused to be smaller than 0.10 but greater than 0.01.

According to another preferred embodiment, the ratio between the cross-sectional area A4 of the illustrated space 16 between said inner gas pipe 2 and the outer protective pipe 3 and the cross-sectional area A2 of the gap 14 between the sleeve 10 and the inner gas pipe 2 lies in the range of 1.0, 2.0.

According to another preferred embodiment of the invention, the ratio between the cross-sectional area A4 of the illustrated space 16 between the inner gas pipe 2 and the outer protective pipe 3 and the cross-sectional area A3 of the inner gas pipe 2 lies in the range 0.75-1.75.

With regard to said ejector effect it is important that the output velocity of the fuel mixture from the sleeve 10 is sufficiently high.

It is preferred that the nozzle velocity of the fuel mixture from the nozzle 13 of the sleeve 10 is caused to exceed 35 m/s.

FIGS. 3 and 4 illustrate the consequences caused by the thermal expansion of the ingoing components. Heating causes the outer pipe 3 to expand linearly to the left in FIGS. 3 and 4. The outer pipe 3 therewith entrains the inner gas pipe 2. However, the inner pipe 2 expands with a starting point from the bottom of the outer pipe, said bottom being located to the left of FIGS. 3 and 4. The inner pipe will expand to a greater extent than the outer pipe, due to the higher temperature of the inner pipe. When the power increases, the inner gas pipe will therefore come closer to the burner head 1, in other words the sleeve will be pushed further into the inner pipe. Compared with room temperature, when the pipe is heated the orifice 15 of the pipe will be displaced closer to the burner head by a distance of about 20 millimetres in the case of the measurement notations given in FIG. 2.

FIG. 3 illustrates an embodiment in which only small displacements occur as a result of thermal expansion. The difference being indicated by the distance 18. FIG. 4 illustrates a greater displacement, indicated by the distance 19. As will be seen, the part of the sleeve that projects into the inner pipe 2 will become longer as the displacements become greater, so as to maintain the size of said gap 14.

Due to this thermal expansion it is highly preferable that the part 17 of the sleeve 10 that co-acts with the inner pipe 2 in forming said gap 14 is cylindrical in shape.

As a result, the gap 14 will have a constant size, regardless of said thermal expansion.

FIG. 2 shows the measurements of that part of the gas burner in question by way of example. At these measurements and at a lambda value close to said value there is obtained an $NO_x$-content of between 20 and 40 ppm, depending on the outlet velocity of the gas from the sleeve orifice.

$NO_x$-values of these low magnitudes obviate the need to equip the burner with catalysts in the fuel gas channel.

It will be obvious that the present invention solves the problems mentioned above.

Although the invention has been described with reference to a number of exemplifying embodiments, it will be understood that the design of the sleeve and the design of the inner gas pipe can be varied in the region of the gap 14.

Accordingly, the invention shall not be considered limited to the described exemplifying embodiments, since modification and variations can be made within the scope of the accompanying claims.

The invention claimed is:

1. A method relating to combustion with the aid of a gas burner for furnace heating purposes, the method comprising the steps of:

using a gas burner with a burner head (1) placed at one end of an inner gas pipe (2), which inner gas pipe is surrounded by an outer protective pipe (3), an exhaust channel (5) leading to surroundings, the inner pipe (2) terminating short of the burner head (1), a sleeve (10) located downstream of the burner head, a terminal part (17) of the sleeve (10) placed concentrically with the one end of the inner pipe (2) so that a sleeve orifice (13) thereof is located within the one end of the inner pipe and a gap (14) is provided between an inner surface of the inner pipe (2) and an exterior portion of the terminal part (17) of the sleeve (10), the exterior portion of the terminal part (17) of the sleeve (10) positioned to co-act with the inner pipe such that said gap (14) being cylindrical in shape, a size of the gap (14) defining a mixture of fuel and combustion air coming from the burner head (1) and re-cycled exhaust gases passing through said gap (14);

flowing fuel gases from the burner head (1) from inside the inner pipe and inside the outer pipe into the exhaust channel (5) which leads to the surroundings; and inserting the terminal part (17) of the sleeve (10) concentrically within the inner pipe (2) so that the sleeve orifice (13) is located within said inner pipe with the gap (14) provided between the opening (15) of the inner pipe (2) and said sleeve (10), wherein the terminal part (17) of the sleeve (10) is inserted at a depth distance within the inner pipe (2) sufficient so that the exterior portion of the terminal part (17) of the sleeve (10) that co-acts with the inner pipe to form said gap (14) is maintained cylindrical in shape along the depth distance to maintain the size of said gap constant during thermal expansion and at full thermal expansion, and wherein the size of the gap (14) is caused to be maintained such that the mixture of fuel and combustion air coming from the burner head (1) and the re-cycled exhaust gases passing through said gap (14) will be mixed in quantities at which the temperature of combustion will be lower than the temperature in which $NO_x$ is formed.

2. A method according to claim 1, characterized by heating to a temperature of roughly 1600 degrees C.

3. A method according to claim 1, characterized by adapting the size of the gap (14) to be such as to cause the $NO_x$-content to be less than 125 ppm.

4. A method according to claim 1, characterized by giving the gap (14) a size at which the $NO_x$-content will be less than 25 ppm.

5. A method according to claim 1, characterized by causing the lambda value to lie close to value one.

6. A method according to claim 5, characterized by causing the lambda value to be 0.940 at the lowest.

7. A method according to claim 1, characterized by causing the ratio between the cross-sectional area (A1) of the sleeve outlet opening (13) and the cross-sectional area (A2) of the gap (14) to be smaller than 0.10 but larger than 0.01.

8. A method according to claim 1, characterized in that the ratio between the cross-sectional area (A4) of the space (16) between the inner pipe (2) and the outer pipe (3) and the cross-sectional area (A2) of the gap (14) between the sleeve (10) and the inner pipe (2) is caused to lie in the range of 1.0-2.0.

9. A method according to claim 1, characterized in that the ratio between the cross-sectional area (A4) of the space (16) between the inner pipe (2) and the outer pipe (3) and the cross-sectional area (A3) of the inner pipe (2) to lie in the range of 0.75-1.75.

10. A method according to claim 1, characterized by causing the outlet velocity of the fuel mixture from the orifice of the sleeve (10) to exceed 35 m/s.

11. A furnace heating gas burner, comprising:

a burner head (1), an inner gas pipe (2) with an orifice (15), an outer protective pipe (3), an exhaust channel (5) leading to surroundings, the burner head placed at one end of the inner gas pipe (2) which inner pipe (2) is surrounded by the outer protective pipe (3), wherewith the fuel gases from the burner head (1) pass inside the inner pipe and also in the outer pipe and thereafter pass into the exhaust channel (5) which leads to the surroundings, the inner pipe (2) terminating short of the burner head (1); and a sleeve (10) provided downstream of the burner head, said sleeve (10) being inserted into and/or placed concentrically with the inner pipe (2) so that the sleeve orifice will be located within the inner pipe, the sleeve (10) having a terminal part (17) that co-acts with the inner pipe (2) to form a gap (14) therebetween, an exterior of the terminal part (17) co-acting with the inner pipe (2) being cylindrical in shape, wherein, the terminal part (17) of the sleeve (10), with the exterior cylindrical in shape, is inserted at a depth distance within the inner pipe (2) sufficient so the a size of the gap (14) formed between an inner surface of the inner pipe (2) and an exterior portion of the terminal part (17) of the sleeve (10) being cylindrical in shape is maintained cylindrical along the depth distance to maintain the size of said gap constant during thermal expansion and at full terminal expansion, and the size of the gap (10) is adapted so that the fuel and combustion air mixture coming from the burner head (1) and the recycled exhaust gases arriving through the gap (14) will be such as to cause the temperature of combustion to be lower than the temperature at which $NO_x$ is formed.

12. A gas burner according to claim 11, characterized in that the ratio between the cross-sectional area (A1) of the sleeve outlet opening (13) and the cross-sectional area (A2) of the gap (14) is smaller than 0.10 but greater than 0.01.

13. A gas burner according to claim 11, characterized in that the ratio between the cross-sectional area (A4) of the space (16) present between the inner pipe (2) and the outer pipe (3) and the cross-sectional area (A2) of the gap (14) between the sleeve (10) and the inner pipe (2) lies in the range of 1.0-2.0.

14. A gas burner according to claim 11, characterized in that the ratio between the cross-sectional area (A4) of the space (16) between the inner pipe (2) and the outer pipe (3) and the cross-sectional area (A3) of the inner pipe (2) lies in the range of 0.75-1.75.

15. A method according to claim 2, characterized by adapting the size of the gap (14) to be such as to cause to $NO_x$-content to be less than 125 ppm.

16. A method according to claim 2, characterized by giving the gap (14) a size at which the $NO_x$-content will be less than 25 ppm.

17. A method according to claim 2, characterized by causing the lambda value to lie close to value one.

18. A method according to claim 2, characterized by causing the ratio between the cross-sectional area (A1) of the sleeve outlet opening (13) and the cross-sectional area (A2) of the gap (14) to be smaller than 0.10 but larger than 0.01.

19. A method according to claim 2, characterized in that the ratio between the cross-sectional area (A4) of the space (16) between the inner pipe (2) and the outer pipe (3) and the cross-sectional area (A2) of the gap (14) between the sleeve (10) and the inner pipe (2) is caused to lie in the range of 1.0-2.0.

20. A furnace heating gas burner, comprising:

a protective outer pipe (3);

a burner head (1);

an inner gas pipe (2) with an opening (15), the inner gas pipe (2) terminating short of the burner head (1), the inner gas pipe being separated from the outer pipe (3) by a space (16);

a cylindrical sleeve (10) terminating with an orifice (13), the orifice located within a terminal part (17) of the sleeve (1), the sleeve (10) joined to a downstream end of the burner head (1) and the terminal part (17) of the sleeve (1) inserted into the opening (15) of the inner gas pipe (2) with the orifice (13) located within the inner pipe (2);

an exterior portion of the terminal part (17) of the sleeve (10) co-acting with the inner tube to form only a single mixing gap (14) located between an inner surface of the opening (15) of the inner pipe (2) and an exterior portion on the terminal part (17) of the sleeve (10), the gap sized to mix fuel and a combustion-air mixture arriving from the burner head and an exhaust gas re-circulated through the gap (14) in a quantity such that the temperature of combustion will be lower than the temperature at which NOx is formed, wherein the exterior portion of the terminal part (17) of the sleeve (10) that co-acts with the inner tube to form said gap (14) is cylindrical and the terminal part (17) of the sleeve (10) is inserted at a depth distance within the inner pipe (2) sufficient so that the exterior portion of the terminal part (17) of the sleeve (10) that co-acts with the inner pipe to form said gap (14) is maintained cylindrical in shape along the depth distance to maintain the size of said gap constant during thermal expansion and at full thermal expansion, wherein, a ratio between a cross-sectional area (A1) of the sleeve outlet opening (13) and a cross-sectional area (A2) of the gap (14) is smaller than 0.10 but greater than 0.01, a ratio between the cross-sectional area (A4) of the space (16) present between the inner gas pipe (2) and the outer pipe (3) and the cross-sectional area (A2) of the gap (14) between the sleeve (10) and the inner pipe (2) lies in the range of 1.0-2.0, the ratio between the cross-sectional area (A4) of the space (16) between the inner pipe (2) and the outer pipe (3) and the cross-sectional area (A3) of the inner pipe (2) lies in the range of 0.75-1.75.

* * * * *